United States Patent [19]

Lambson et al.

[11] Patent Number: 4,793,427

[45] Date of Patent: Dec. 27, 1988

[54] DISC CUTTERS FOR ROCK WORKING MACHINES

[75] Inventors: Roger S. Lambson; Noel C. Pope, both of Johannesburg; Vaughan Griffiths, Springs, all of South Africa

[73] Assignee: Boart International Limited, Sandton, South Africa

[21] Appl. No.: 7,011

[22] Filed: Jan. 27, 1987

[30] Foreign Application Priority Data

Jan. 28, 1986 [ZA] South Africa ..... 86/0627

[51] Int. Cl.[4] ..... E21B 10/12

[52] U.S. Cl. ..... 175/373; 175/374

[58] Field of Search ..... 175/364, 371–374; 299/86; 30/347; 172/604

[56] References Cited

U.S. PATENT DOCUMENTS

| | | | |
|---|---|---|---|
| 3,204,710 | 9/1965 | Bechem | 175/351 X |
| 3,216,513 | 11/1965 | Robbins et al. | 175/227 |
| 3,766,998 | 10/1973 | Bower, Jr. | 175/372 X |
| 3,981,370 | 9/1976 | Bingham et al. | 175/373 |
| 3,982,595 | 9/1976 | Ott | 175/351 X |
| 4,004,645 | 1/1977 | Rees et al. | 175/373 |

*Primary Examiner*—Stephen J. Novosad
*Assistant Examiner*—David J. Bagnell

[57] ABSTRACT

A hardmetal ring is a size for size or low interference fit on the body of a disc cutter of a rock working machine, such as a boxhole borer. In one embodiment the ring is gable shaped and clamped between a fixed annular shoulder and a detachable annular shoulder. In another embodiment the ring is triangular in section and two annular shoulders resting on it and inclined surfaces on the body clamp the ring to the body.

3 Claims, 2 Drawing Sheets

DISC CUTTERS FOR ROCK WORKING MACHINES

BACKGROUND TO THE INVENTION

This invention relates to disc cutters for rock working machines such as raise borers and boxhole borers.

Conventional disc cutting machines of the type in question have disc cutters which comprise a body journalled for rotation about a shaft secured to the rock working machine. On the body there is a steel cutting ring which is secured with a high interference fit as by heat shrinking. When hard abrasive rock has to be worked, the steel rings on conventional cutting discs blunt very quickly so that rock working machines with cutting discs become uneconomical to use.

It has therefore been proposed to replace the steel cutting edge in such a disc with hardmetal such as cobalt cemented tungsten carbide or titanium carbide. The earliest proposals in this regard dealt with the fixing of segments of hardmetal on the body—see U.S. Pat. Nos. 3,981,370 and 3,982,595. These proposals did not, however, come into practical use, probably because of failures at the abutting faces of the segments.

In U.S. Pat. No. 3,766,998 the use of a continuous ring of hardmetal is proposed. The ring is lozenge shaped in cross-section and is clamped between inclined faces which exert a radially outward hoop stress. The patent cautions against applying too much tensile stress to the ring, but it advocates the use of some amount of tensile stress to start with. This proposal has also not been commercialised and the applicant believes that such a ring would fail in use due to the cumulative effects of the initial hoop stress and hoop stresses caused by the cutting loads. The geometry of the ring support does not have sufficient stiffness to provide adequate support to the ring. The induced tensile hoop stresses in the lower portion of the profile due to cutting loads superimposed on the tensile hoop stresses due to fitting will cause the ring to break.

SUMMARY OF THE INVENTION

According to the invention a cutting ring of hardmetal is a size for size fit or a low interference fit on the body, is held on the body by two flanking annular shoulders without exerting any radially outward forces on the cutting ring, and at least one of the shoulders is detachable.

In one form of the invention the cutting ring is gable shaped in section with two parallel faces radiating from the body and the ring is flanked by a fixed shoulder and a detachable shoulder.

In another form of the invention the ring is triangular in section and is flanked by two shoulders detachably secured to inclined faces on the body and resting against the inclined faces of the ring.

DESCRIPTION OF EMBODIMENTS

In each of the embodiments a body 10 is journalled to a shaft 11 by means of suitable roller bearings in a conventional manner.

Figure 1:
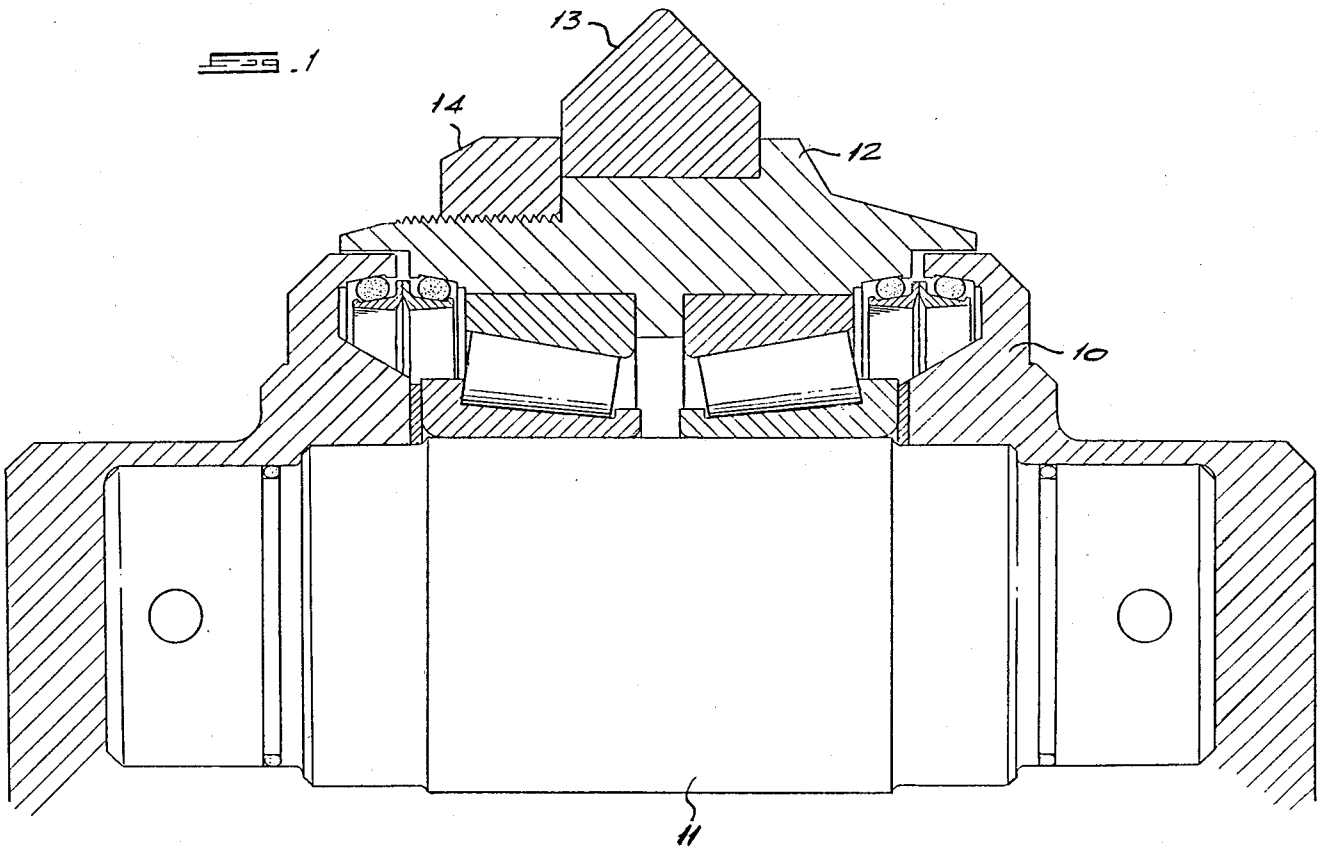
FIG. 1 is a part section through one embodiment of the invention.

In the embodiment of FIG. 1 the body 10 is formed with a fixed shoulder 12. Against the shoulder there rests a gable-section cutting ring 13 made of cemented tungsten carbide. Circumferentially the ring 13 is a locational fit on the body 10. A detachable annular shoulder 14 is screwed on to the body 10.

Figure 2:
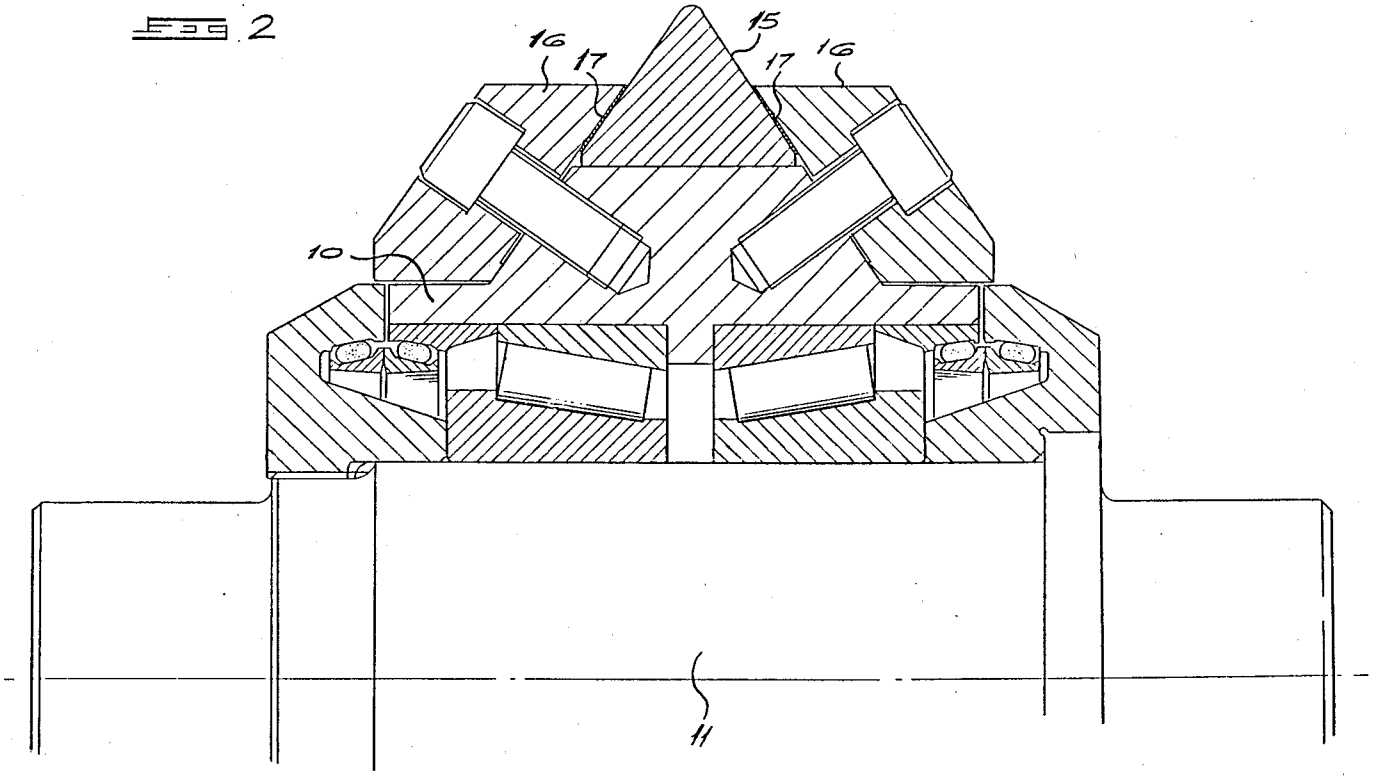
FIG. 2 is a similar view of another embodiment.

In FIG. 2 there is a cutting ring 15 which is triangular in section. The ring 15 is a locational fit on the body 10. On each side of the ring 15 there is an annular clamping ring 16 attached to inclined faces on the body 10 by means of cap screws. The purpose of the clamping rings 16 is to introduce residual compressive stresses into the hardmetal ring 15 while locating it in position. Brass shims 17 are interposed between the rings 16 and 15 to ensure uniform compression.

In each embodiment the ring 13 or 15 is securely held against sideways movement. The rings are readily resharpenable.

Laboratory tests have shown that for a given penetration the cutting forces for the hardmetal cutter of FIG. 1 are essentially the same as those for a sharp steel disc cutter in norite. However a blunt steel disc cutter produced only half the penetration of the hardmetal cutter for a given force. This is illustrated by the following table:

| | Sharp Steel | | Blunt Steel | | Hardmetal | |
|---|---|---|---|---|---|---|
| | Thrust Force | Rolling Force | Thrust Force | Rolling Force | Thrust Force | Rolling Force |
| Penetration (2 mm) | 141 kN | 8,3 kN | 194 kN | 10,7 kN | 153 kN | 7,7 kN |
| Penetration (4 mm) | 188 kN | 17,7 kN | 271 kN | 17,7 kN | 191 kN | 13,8 kN |

A partial field test using six disc cutters according to FIG. 1 on a Robbins boxhole borer was conducted. The other seven cutters had conventional steel cutting rings. A hole 55 m long was bored. The steel cutting rings had to be replaced at 31 m and at the end of the 55 m bore the steel rings required replacement once more. On the other hand the six hardmetal rings were intact and from wear measurements made, it was predicted that the hardmetal rings would each have a cutting life of 400 m. Under the same conditions steel rings have an average life of 25 m.

We claim:

1. A disc cutter for a rock working machine comprising a body journalled for rotation about a shaft adapted to be secured to the machine and a continuously annular, non-segmented cutting ring which is secured to the body characterized in that the cutting ring comprises hardmetal, i.e., cemented metal carbide, and defines a continuous, uninterrupted, annular cutting edge of hardmetal, the cutting ring is a size-for-size fit or a low interference fit on the body, is mounted on the body without tensile hoop stress, and is held on the body by two flanking annular shoulders without exerting any radially outward, i.e., tensile hoop, forces on the cutting ring, and at least one of the shoulders is detachable.

2. The disc cutter claimed in claim 1 in which the cutting ring is gable shaped in section with two parallel faces radiating from the body and the ring is flanked by at least one detachable shoulder.

3. The disc cutter claimed in claim 1 in which the cutting ring is triangular in section with two inclined faces and is flanked by two shoulders detachably secured to inclined faces on the body and resting against the inclined faces of the ring.

* * * * *